United States Patent [19]

Karamon et al.

[11] Patent Number: 4,557,895

[45] Date of Patent: Dec. 10, 1985

[54] YELLOW GOLD ALLOY

[75] Inventors: Robert J. Karamon; Robert T. Allen, both of Indianapolis, Ind.

[73] Assignee: Herff Jones, Inc., Indianapolis, Ind.

[21] Appl. No.: 679,668

[22] Filed: Dec. 10, 1984

[51] Int. Cl.[4] ..... C22C 30/02; C22C 5/08

[52] U.S. Cl. ..... 420/587; 420/580; 420/582; 63/21

[58] Field of Search ..... 420/587, 582; 63/21

[56] References Cited

U.S. PATENT DOCUMENTS

| | | | |
|---|---|---|---|
| 1,965,012 | 7/1934 | Taylor | 75/1 |
| 3,424,577 | 1/1969 | Nielsen et al. | 75/134 |
| 3,767,391 | 10/1973 | Tuccillo et al. | 75/134 C |
| 3,925,066 | 12/1975 | Kobru et al. | 75/134 C |
| 4,255,191 | 3/1981 | Kropp | 75/134 N |
| 4,264,359 | 4/1981 | Harris et al. | 75/134 B |
| 4,350,527 | 9/1982 | Davitz | 75/173 C |
| 4,370,164 | 1/1983 | Harris et al. | 420/503 |
| 4,396,578 | 8/1983 | Bales | 420/587 |
| 4,446,102 | 5/1984 | Bales | 420/507 |

FOREIGN PATENT DOCUMENTS 2638836 8/1979 Fed. Rep. of Germany .

*Primary Examiner*—Veronica O'Keefe
*Attorney, Agent, or Firm*—Herff Jones, Inc.

[57] ABSTRACT

A yellow gold alloy which resembles 10 karat gold in appearance and physical properties but has a gold content substantially less than 10 karat gold. The alloy consists essentially of 11% to 16% by weight gold, 28% to 34% by weight silver, 30% to 38% by weight copper, 8% to 12% by weight palladium, 7% to 10% by weight zinc, 0.2% to 0.4% silicon, and about 0.02% boron, and is particularly well suited for use in the manufacture of rings and other jewelry articles.

5 Claims, No Drawings

YELLOW GOLD ALLOY

BACKGROUND OF THE INVENTION

This invention relates to a yellow gold alloy which resembles 10 karat gold in appearance, properties and characteristics, but which has a much lower gold content.

Gold alloys, particularly 14 karat gold (58.3% by weight gold) and 10 karat gold (41.6% by weight gold) are widely used in the manufacture of rings and other articles of jewelry. The properties and characteristics of such gold alloys, such as color, tarnish resistance, corrosion resistance, workability, and castability are highly desired for jewelry purposes.

In view of the increased cost of gold, attempts have been made to develop gold alloys having the appearance and characteristics of 10 karat gold but containing less gold in order to reduce the cost of the alloy. The following patents are representative of prior art attempts to produce jewelry alloys having a gold content less than 10 karat: U.S. Pat. Nos. 4,446,102 to Bales; 4,370,164 to Harris et al; 4,350,527 to Davitz; 4,276,086 to Murao; 4,264,359 to Harris et al; 4,255,191 to Kropp; 3,767,391 to Tuccillo et al; 3,925,066 to Kobru et al; 1,965,012 to Taylor; and German Pat. No. 2,638,836. These prior efforts have not been entirely successful in providing an alloy having a cost substantially less than 10 karat gold in addition to having the desirable properties, characteristics and appearance of 10 karat gold.

SUMMARY OF THE INVENTION

The present invention provides a yellow gold alloy which has a gold content substantially less than 10 karat gold, but which resembles 10 karat gold in appearance and has properties and characteristics substantially similar to 10 karat gold. The alloy of this invention contains about 11% to 16% by weight gold and has good tarnish resistance, corrosion resistance, workability and castability. Thus, the invention provides a low cost yellow gold alloy which retains essentially all the desirable characteristics and properties of higher gold content alloys.

DETAILED DESCRIPTION OF THE INVENTION

In accordance with the present invention, a yellow gold alloy is provided which consists essentially of 11% to 16% gold, 28% to 34% silver, 30% to 38% copper, 8% to 12% palladium, 7% to 10% zinc, 0.2% to 0.4% silicon, and about 0.02% boron. Unless otherwise indicated, all parts and percentages used herein are by weight. A preferred alloy of this invention consists essentially of 12% gold, 30% silver, 37.68% copper, 10% palladium, 10% zinc, 0.3% silicon and 0.02% boron.

The alloy of this invention provides a relatively low cost substitute for conventional gold alloys for use in the manufacture of rings and other jewelry articles. Despite its reduced gold content, the present alloy has the appearance, properties and characteristics substantially similar to 10 karat gold. Thus, the alloy has a pleasing light yellow color comparable to 10 karat yellow gold. Tarnish resistance to normal tarnishing agents, such as sulfurated potash gas, is similar to that of 10 karat gold. The alloy is of sufficient hardness to take a normal jewelry finish, either bright or textured, with the alloy having an average hardness of 75RB. It can be worked, cast, molded, engraved, soldered and stamped using existing techniques with normal jewelry equipment. The present alloy is particularly well suited for investment casting of rings or similar jewelry articles as the alloy holds very good depth tolerances and uniformity of composition. Corrosion resistance is also substantially the same as that of conventional 10 karat gold. The alloy is superior in workability to low gold content alloys which contain indium as an alloying agent.

The alloy of this invention may be manufactured by standard procedures used in the manufacture of precious metal alloys. The alloy, which has a melting range of 1325° F. to 1475° F., may be prepared by simply weighing out the proper proportions of the constituents, placing them in a refractory crucible and subjecting them to a heat sufficient to melt the materials. Care should be taken to insure uniform alloying and mixing of the constituents. For example, the melt should be stirred with a graphite rod before pouring into grain form to assure uniform alloying. High quality castings can be prepared by heating the alloy grain to a temperature of 1800° F. to 1850° F. and pouring into investment molds which have been preheated to a temperature of 1000° F. to 1100° F.

In the manufacture of the alloy, it is desirable to use a copper-boron alloy, such as one containing about 2% boron, as the source of boron to be incorporated into the final alloy. The presence of boron in the alloy is principally to provide good castability by virtue of the deoxidizing effect of the boron. A silicon-copper alloy is also used to promote the production of sound castings. Boric acid may be used as a flux to assist in reducing undesired impurities.

The proportions of components of the alloy may be varied within the limits set forth above. However, in order to obtain an alloy having the appearance, properties and characteristics closely simulating 10 karat gold, the percentages of the components are to be within the percentage ranges disclosed.

What is claimed is:

1. A yellow gold alloy consisting essentially of 11% to 16% by weight gold, 28% to 34% by weight silver, 30% to 38% by weight copper, 8% to 12% by weight palladium, 7% to 10% by weight zinc, 0.2% to 0.4% by weight silicon, and about 0.02% by weight boron.

2. The alloy defined in claim 1 in which gold is about 12% by weight.

3. A yellow gold alloy which consists essentially of about 12% by weight gold, about 30% by weight silver, about 37.68% by weight copper, about 10% palladium, about 10% zinc, about 0.3% silicon and about 0.02% boron.

4. An article of jewelry formed of the alloy of claim 1.

5. An article of jewelry formed of the alloy of claim 3.

* * * * *